US010550681B2

(12) United States Patent
Yuan et al.

(10) Patent No.: US 10,550,681 B2
(45) Date of Patent: Feb. 4, 2020

(54) BOTTOM-UP GRAVITY-ASSISTED PRESSURE DRIVE

(71) Applicant: BITCAN GEOSCIENCES & ENGINEERING INC., Calgary (CA)

(72) Inventors: Yanguang Yuan, Calgary (CA); Mingzhe Dong, Calgary (CA)

(73) Assignee: Bitcan Geosciences & Engineering Inc., Calgary, Alberta (CA)

( * ) Notice: Subject to any disclaimer, the term of this patent is extended or adjusted under 35 U.S.C. 154(b) by 0 days.

(21) Appl. No.: 15/319,225

(22) PCT Filed: Jun. 18, 2015

(86) PCT No.: PCT/CA2015/000400
§ 371 (c)(1),
(2) Date: Dec. 15, 2016

(87) PCT Pub. No.: WO2015/192217
PCT Pub. Date: Dec. 23, 2015

(65) Prior Publication Data

US 2017/0130572 A1 May 11, 2017

(30) Foreign Application Priority Data

Jun. 18, 2014 (CA) ..... 2,854,523

(51) Int. Cl.

| | |
|---|---|
| ***E21B 43/30*** | (2006.01) |
| ***E21B 43/14*** | (2006.01) |
| ***E21B 43/16*** | (2006.01) |
| ***E21B 43/24*** | (2006.01) |
| ***E21B 43/26*** | (2006.01) |
| ***E21B 43/267*** | (2006.01) |

(52) U.S. Cl.
CPC ..... *E21B 43/305* (2013.01); *E21B 43/14* (2013.01); *E21B 43/164* (2013.01); *E21B 43/168* (2013.01); *E21B 43/2406* (2013.01); *E21B 43/2408* (2013.01); *E21B 43/26* (2013.01); *E21B 43/267* (2013.01)

(58) Field of Classification Search
CPC .... E21B 43/2408; E21B 43/305; E21B 43/14; E21B 43/164; E21B 43/168; E21B 43/2406; E21B 43/26; E21B 43/267; E21B 43/17
See application file for complete search history.

(56) References Cited

U.S. PATENT DOCUMENTS

| | | | | |
|---|---|---|---|---|
| 4,086,964 A * | 5/1978 | Dilgren | C09K 8/592 | 166/252.1 |
| 4,856,588 A * | 8/1989 | Borchardt | C09K 8/518 | 166/275 |
| 8,056,624 B2 * | 11/2011 | Gates | E21B 43/305 | 166/250.01 |
| 8,235,110 B2 * | 8/2012 | Larter | C09K 8/58 | 166/250.01 |

(Continued)

*Primary Examiner* — Jennifer H Gay
(74) *Attorney, Agent, or Firm* — Field LLP

(57) ABSTRACT

A method is taught for producing hydrocarbons from a reservoir by drilling two or more wells located proximal a bottom of said reservoir. The method comprises initiating one or more high-mobility zones connecting said wells along the bottom of the reservoir and producing the reservoir from the bottom of said reservoir upwards.

20 Claims, 9 Drawing Sheets

(56) References Cited

U.S. PATENT DOCUMENTS

| | | | | |
|---|---|---|---|---|
| 2009/0260823 | A1* | 10/2009 | Prince-Wright | C10G 21/22 166/302 |
| 2010/0012331 | A1* | 1/2010 | Larter | C09K 8/58 166/401 |
| 2011/0017458 | A1* | 1/2011 | East, Jr. | E21B 43/26 166/308.1 |
| 2011/0247816 | A1* | 10/2011 | Carter, Jr. | E21B 43/26 166/298 |
| 2013/0000898 | A1* | 1/2013 | Boone | E21B 43/2408 166/272.7 |
| 2013/0081808 | A1* | 4/2013 | Zeidani | C09K 8/592 166/272.4 |
| 2014/0216739 | A1* | 8/2014 | Brown | E21B 43/2408 166/272.3 |
| 2015/0176382 | A1* | 6/2015 | Chakrabarty | E21B 43/24 166/252.5 |
| 2015/0300327 | A1* | 10/2015 | Sweatman | E21B 43/25 60/641.2 |
| 2017/0130572 | A1* | 5/2017 | Yuan | E21B 43/2408 |
| 2017/0145295 | A1* | 5/2017 | Nguyen | E21B 43/26 |
| 2017/0226836 | A1* | 8/2017 | Sanders | E21B 43/2408 |

* cited by examiner

Forming a flat stimulant chamber after initiating the one or more high-mobility zones and prior to producing hydrocarbons along the bottom between the two or more wells.

Fig. 1b

BOTTOM-UP GRAVITY-ASSISTED PRESSURE DRIVE

FIELD OF THE INVENTION

The present invention relates to a method of producing viscous hydrocarbons from a formation using mechanisms of gravity drain and pressure difference between wells located near the bottom of the formation.

BACKGROUND OF THE INVENTION

Extraction of hydrocarbons from subterranean formations is an important global industry. Fuels derived from these hydrocarbons form the core energy supply for most of the industrialized world. The petroleum industry is faced with two significant challenges. On one hand, the conventional light oil has mostly been depleted via the primary production and waterflood and enhanced recovery processes must be enacted to increase the production. The enhancement typically relies on injection of external materials in one well, which then sweeps the remaining in-situ hydrocarbon liquid towards the production well.

On the other hand, unconventional oil reservoirs are difficult to produce via primary production means and must rely on stimulation. In North America and many other parts of the world, hydrocarbons are found in heavy and viscous forms such as bitumen and heavy oils, which are extremely difficult to extract. The bitumen-saturated oilsands reservoirs of Canada, Venezuela, California, China and other parts of the world are just some examples of such subterranean formations. In these formations, it is not possible to simply drill wells and pump out the oil. Instead, the reservoirs are heated or otherwise stimulated to reduce viscosity and promote extraction. Steam flooding, Cyclic Steam Stimulation (CSS) and Steam Assisted Gravity Drainage (SAGD) are some of the examples.

In either enhanced recovery of the conventional reservoirs or stimulation of the unconventional oil reservoirs, their production depends on two major functions acting simultaneously: one is stimulation and the other is sufficient drive energy. As an example of stimulation, viscosity of the in-situ heavy oil or bitumen is reduced through injection of steam, solvent or whatever other materials. In another example, interfacial tension between the in-situ hydrocarbon liquid and the displacing fluid is reduced by injection of chemicals so that it becomes more readily mobile. Equally important is the contact area for the injected materials with the reservoir. A contact area as large as possible and attained as early as possible is desired.

The other major function in producing the conventional reservoirs via enhanced recovery processes or producing the unconventional reservoirs via stimulation is to provide sufficient drive energy for the stimulated hydrocarbon liquid to be produced. In steam flooding, the driving energy is the pressure difference between the injection and production wells. In CSS, the drive energy is the pressure difference between inside the reservoir and the production well. In SAGD, the drive energy is gravity.

The above-described two functions should work together simultaneously. For example, in steam flooding, the pressure difference provides significant drive energy for the production. However, injected steam can easily and undesirably travel over the in-situ hydrocarbon liquid thereby bypassing the desired product to be flooded. When this breakthrough occurs, the drive energy from the pressure difference becomes significantly reduced. In addition, it has been realized, for example in Butler, U.S. Pat. No. 4,344,485, that fluid mobility is restricted at the flooding front where the mobilized hydrocarbon, injected materials and in-situ hydrocarbon are mixed together.

Recognizing the problem of restricted fluid mobility at the flooding front, Shell Canada Ltd. has experimented using the CSS process to first produce from behind the flooding front until fluid mobility restriction is eventually overcome, then steam flooding is used. Their process is described not to rely on gravity or vertical flow (Section 4.1 in "Application for Approval of the Carmen Creek Project, Volume 1: Project Description" made to Energy Resource Conservation Board (ERCB) of Alberta, Canada in November 2009). The whole reservoir thickness is open to the steam injection.

In SAGD, the drive energy comes from the gravity. It uses steam or other viscosity-reducing agent to contact the reservoir. The viscosity-reduced bitumen or heavy oil drains away from the contact front due to the density difference between the various phases, making the contact front substantially full of fresh injected steam or other agents.

Despite its commercial success, the SAGD process is still subject to the following drawbacks:

(1) Its contact with the reservoir is relatively small. This is especially true during the early stage of the operation. In the conventional circulation start-up phase of a SAGD operation made up of a horizontal well pair, the reservoir contact is near-cylindrical shaped and more or less co-axial with the wells. During the ramping up phase, the steam chamber extends nearly vertically to the reservoir top, increasing the reservoir contact to a near-rectangular shape extending along the horizontal well length. During the blow-down phase, the reservoir contact spreads out laterally but does not spread across the whole reservoir width. The less the contact area, the less stimulation, and the less production.

(2) Gravity as the driving force in reservoir production is less energetic that pressure differential. As the SAGD steam chamber reaches the reservoir top, it spreads laterally and its slope gradually decreases, thus reducing effectiveness of the gravity drainage.

(3) In SAGD, the steam chamber reaches the reservoir top very early. Afterwards, it spreads out laterally, which causes more and more thermal energy to be lost to the overburden rock. Moreover, long periods of heat contacting the overburden rock can also induce rock deformation, causing the caprock integrity concerns. SAGD is not applicable or less economic in reservoirs with complex geological features at their top, such as top gas, top water, compromised or non-existent competent caprock. A SAGD operation may not be economic in a thin reservoir due to the energy loss to the overburden.

(4) In a SAGD pad, a pocket of unrecovered bitumen forms in the space between two adjacent well pairs. An additional well can be drilled to access the bitumen for increasing the total recovery of oil but drilling cost is high.

In the injection cycles of a CSS process, steam is injected into the formation at pressures high enough to dilate the pore spaces. At the end of the injection cycles the pressure and temperature are the highest in the vicinity of the well and so is the steam saturation. At the beginning of the production cycles, steam with the highest energy values has to be recovered first before the oil from the remote portions of the reservoir can be produced as the reservoir pressure becomes low. Therefore, the major drawbacks of the CSS process are: (1) the energy efficiency is low due to the fact that heating value produced at the beginning does not contribute much to the oil production, (2) the displacement process is not efficient because the swept zone near the production well becomes increasingly larger with the cycles and the back and forth flow of the steam in this zone, and (3) in the late cycles the oil produced from remote portions of the reservoir has to flow through a long distance of the swept zone to be produced.

There is therefore a need to provide stimulation or enhanced recovery processes that optimize simultaneously on stimulation and drive energy.

SUMMARY OF THE INVENTION

A method is taught of producing hydrocarbons from a reservoir. The method comprises drilling two or more wells located proximal a bottom of said reservoir, initiating one or more high-mobility zones connecting said wells along the bottom of the reservoir and producing the reservoir from the bottom of said reservoir upwards.

The method may further comprise the step of forming a flat stimulant chamber after initiating the one or more high-mobility zones and prior to producing hydrocarbons along the bottom of the reservoir between the two or more wells.

The method may further comprise the steps of injecting a stimulant through a first one or more injector wells into the reservoir at a pressure that is greater than the formation pressure of the reservoir to form the flat stimulant chamber in the one or more high-mobility zones, producing at least one of condensed stimulant and hydrocarbon from a second one or more production wells of the two or more wells and continuously injecting stimulant at the first one or more injection wells while producing hydrocarbon at the second one or more production wells by a combination of gravity drainage and pressure drive.

BRIEF DESCRIPTION OF THE DRAWINGS

FIGS. 1*a*, 1*b* and 1*c* are flowcharts of the steps performed in the present process;

DETAILED DESCRIPTION OF THE PREFERRED EMBODIMENTS

Figure 1A:
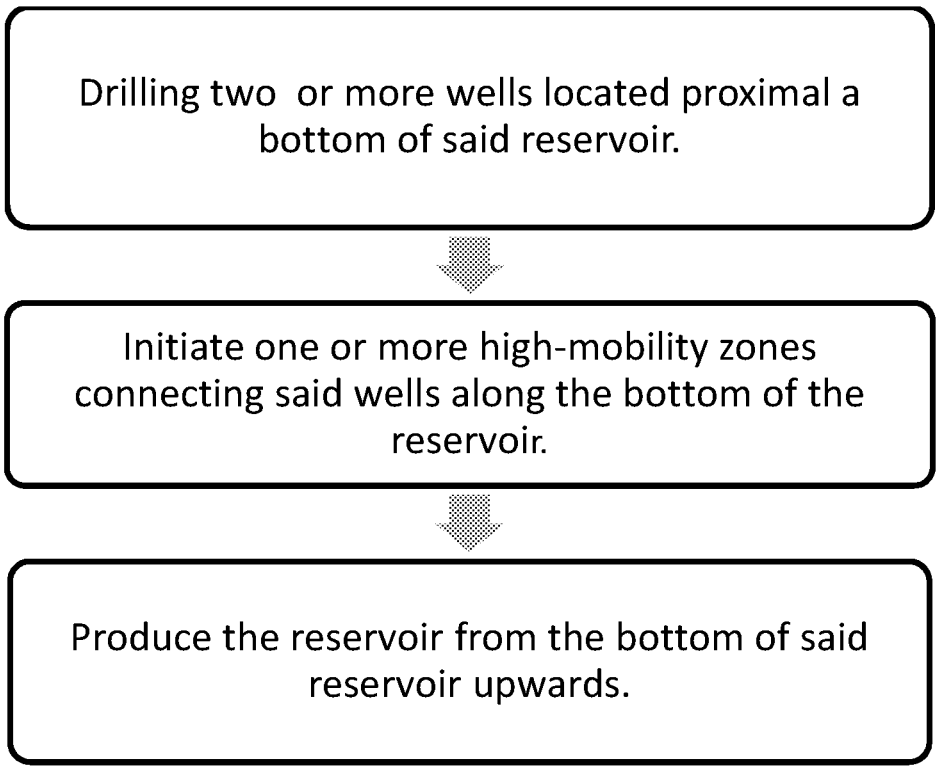

The present invention teaches a stimulation strategy to create a large contact area in a hydrocarbon reservoir from the beginning of the process, combine gravity drainage and pressure drive as the production-driving mechanisms and produce the reservoir from its base in a generally uniform upwards direction.

The present invention utilizes gravity and pressure difference as the drive energy. These two mechanisms act on the formation together from the initial stages of the process through to the end. Because of the difference between their densities, gravity causes oil to drain down while the lighter stimulants tend to rise up, thereby creating more uniform conformance of the stimulant in the reservoir and more uniform oil drainage downwards. Pressure difference controls lateral movement of the injected stimulants and downward-draining oil to be displaced to the production well. The present invention aims to distribute the stimulant across the lateral extent of the reservoir from early stages of the process and maintains the stimulation in this manner throughout production.

The present process can result in a faster reservoir production than conventional processes and can result in a more complete reservoir recovery with better thermal efficiency due to the fact that there is no heat loss to the overburden. This is reflected in the smaller cumulative steam-oil ratio if steam is used as the stimulant, for example.

The present invention provides a new method of producing petroleum oil reservoirs; starting close to the bottom of the reservoir and progressing upwards with relatively flat horizontal fronts. Many variations of well configurations, injected materials and production means can be practised within this invention. The method has six basic characteristics:

(1) The present method seeks to achieve early communication between two wells along the bottom of the reservoir. The inter-well communication is created close to the bottom of the reservoir. A horizontal, high-mobility zone is formed before the recovery process starts. There are a variety of methods that may be used in the present invention to create such a high-mobility zone if it is not naturally present.

(2) Stimulants, that is, materials used to stimulate the reservoir, are injected into the horizontal high-mobility zone that is formed a prior near the bottom of the reservoir. As a result, a flat stimulant chamber is formed at the very start of reservoir recovery and the present invention provides a large stimulant-oil contact area from the initial stages of the process.

(3) The stimulant is preferably lighter than the oil contained in the reservoir and tends to rise upwards, in turn replacing the oil contained in the reservoir pores so that the latter will drain downwards due to gravity.

(4) Drained oil in the stimulant chamber is driven by the injected stimulant to the production well due to the pressure difference between these wells. This process is particularly appealing to producing the oilsands or heavy oil reservoirs where steam or other stimulants are required to reduce the oil viscosity. However, the process can be applied to any reservoirs which require secondary or tertiary recovery processes. The latter includes depleted reservoirs after the primary production.

(5) The stimulant front progresses relatively uniformly upwards from the bottom until the front hits a horizontal permeability barrier, thus enabling a faster and more complete reservoir recovery below such a barrier. The ideal barrier is the natural top of the reservoir such as shaly and/or less-oil saturated intervals. For example, Clearwater shale, Wabiskaw shale or McMurray shale in the context of oilsands development in Alberta, Canada is such an ideal barrier.

(6) Furthermore, when the stimulant front reaches the top of the reservoir or the bottom of the overburden, the reservoir is mostly stimulated or recovered. This significantly reduces the time for the stimulant to contact with the overburden. In the case when the stimulant is heated, the reduced exposure time leaves minimum heat in the stimulant to be lost to the overburden. This increases the energy efficiency, reduces mechanical impact on the caprock and minimizes adverse influences by top reservoir features such as top water, top gas or where competent caprock is absent or questionable.

Figure 1C:
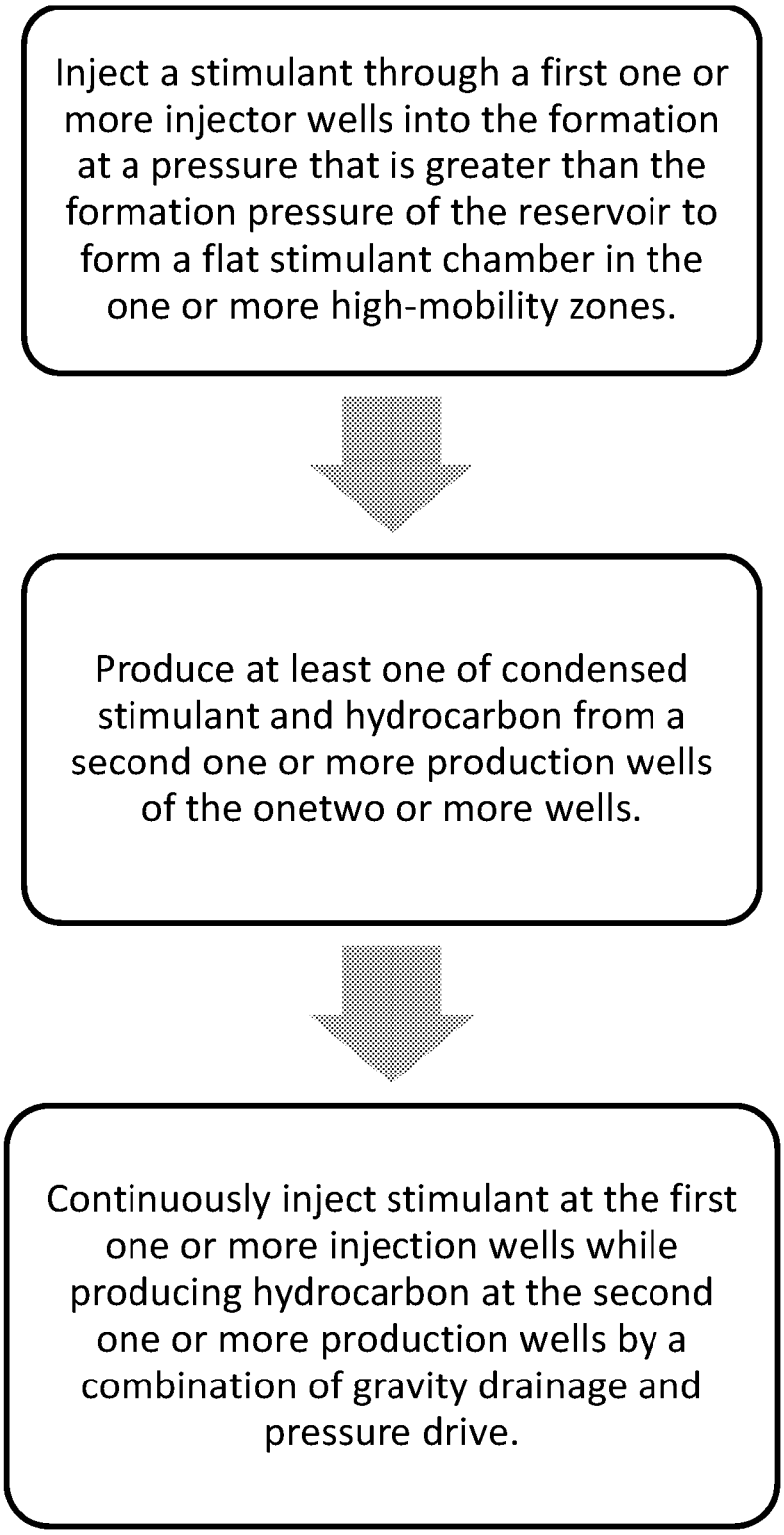

The steps of producing the reservoir via the present method are generally illustrated in FIG. 1*a* and more preferably embodiments and steps are illustrated in FIGS. 1*b* and 1*c*.

Figure 2:
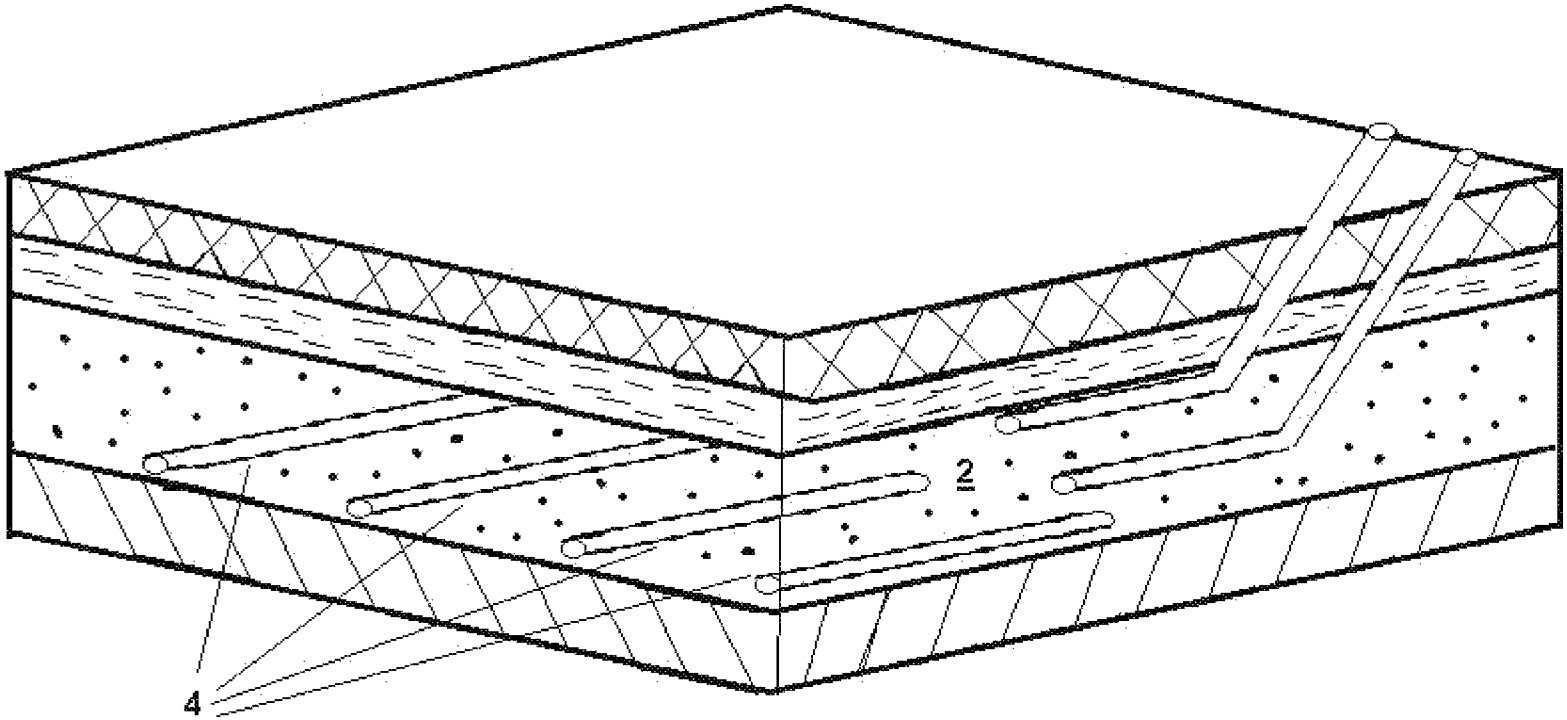
FIG. 2 is cross sectional view of the multiple wells completed in hydrocarbon-bearing reservoirs.

As illustrated in FIG. 2, two or more wells 4 are drilled in a substantially horizontal direction, substantially parallel and co-planar to one another with a certain horizontal distance apart and each of the wells 4 is close to the bottom of the reservoir. The length of the horizontal wells 4 or the horizontal spacing between the horizontal wells 4 can vary. Preferably, the well length can range from 400 to 800 m, a common length typically seen in SAGD operation. Ease of drilling and completion, geological condition, reservoir quality and economics all influence the choice of the well length. The present method does not require that the horizontal wells 4 of this preferred length be segmented into subsections via downhole packers. The horizontal wells 4 need not to be of a similar length; however, a similar length does permit uniform recovery of the reservoirs.

The inter-well spacing between wells is also what would be commonly seen in the art, for example between 30 and 50 m. Since such well spacing may be less than the width of the reservoir to be produced, more than two wells in alternating injector and producer pairs may be drilled and spaced at a predetermined well spacing to cover the full width of the reservoir. Geological conditions, reservoir quality and economics all influence the choice of the inter-well spacing. For example, a wider inter-well spacing can be more economical since fewer wells need to be drilled. On the other hand, wider inter-well spacing may make the process more difficult to manage. Thus, a balance is needed in deciding the inter-well spacing. In general, a good characterization effort for the geological condition and reservoir properties coupled with numerical simulations can yield the most optimum inter-well spacing design. Of course, field operation experience will eventually influence the decision too.

In some cases, the reservoirs to be produced may have one or more inter-bed shale layers or other permeability barriers present through the depth of the reservoir. In such cases, the reservoir may be considered to be made up of one or more reservoirs, each separated by such permeability barriers, and for the purposes of the present invention, the phrase "bottom of the reservoir" will be understood to include the area just above and proximal to each of said inter-bed permeability barriers. In these circumstances it may be desirable to have one or more wells drilled at the bottom of each of these reservoirs just above each inter-bed permeability barrier.

Figure 3A:
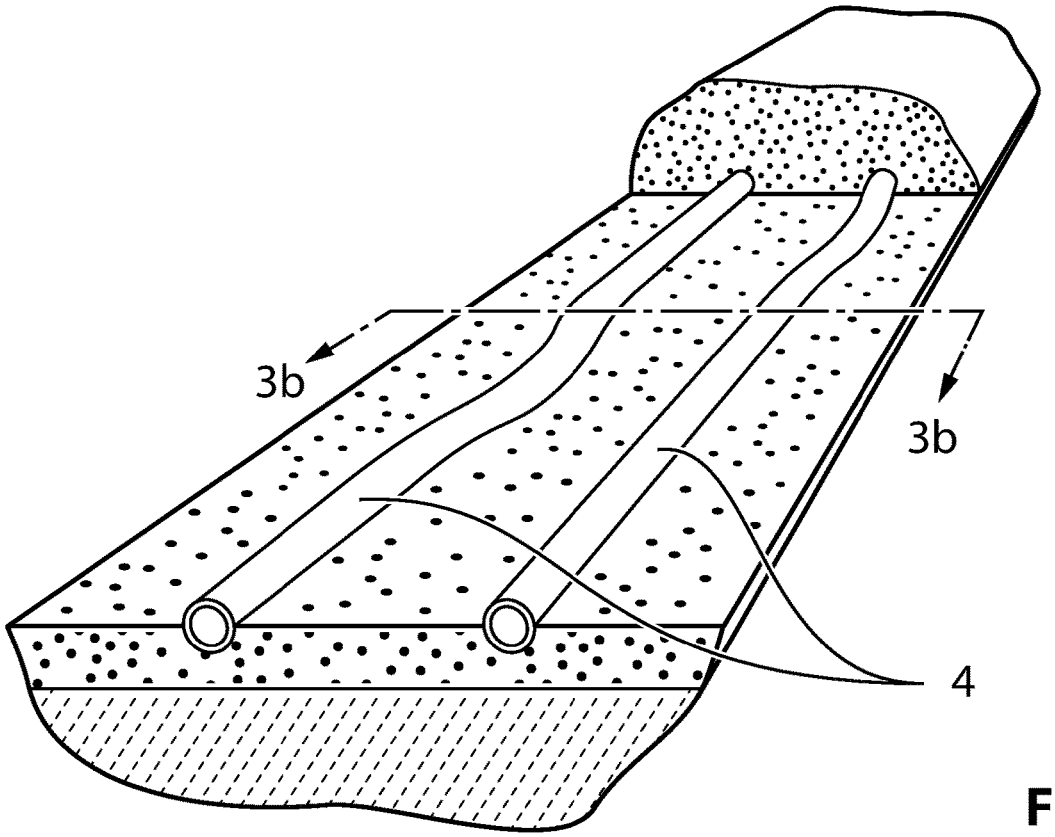
FIGS. 3*a* to 3*b* are perspective and front elevation views of two wells of the present invention, illustrating examples of local inhomogeneities and well variances seen during well drilling and completion.
Figure 3B:
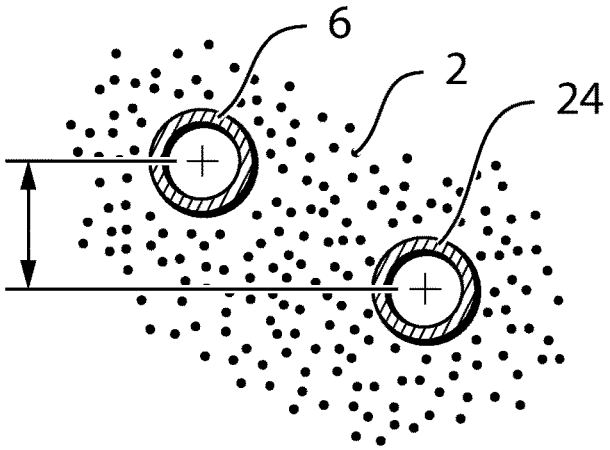

As seen in FIGS. 3*a* and 3*b*, the wells may have irregularities in their shape along the length of the wells and a small offset in the vertical direction between the wells 6 and 24 is permitted either to follow the topography of the reservoir base or to allow better gravity drainage from the injection 6 to production wells 24.

It should be noted that the present invention is equally applicable to vertical wells or inclined wells. The vertical or inclined wells can be spaced apart to cover a certain width of the reservoir and can extend the entire depth of the reservoir. In such cases, the wells are preferably cased and perforated near the bottom of the reservoir. The perforation depth of each of the two vertical wells is preferably at substantially similar distances to the bottom of the reservoir.

Horizontal wells are preferred for the present process, as they enable better and larger reservoir contact.

Figure 4:
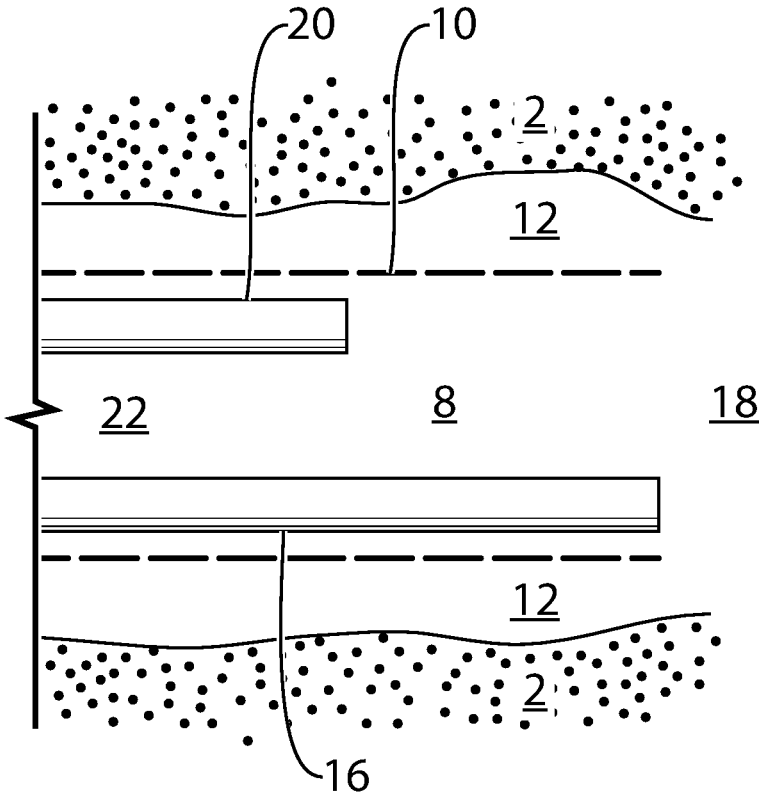
FIG. 4 is a plan view of the on embodiment of completing wells of the present invention.

Well completion for the horizontal wells 4 in the present invention can be borrowed from the SAGD industry. For example, as shown in FIG. 4, it has a long horizontal openhole section 8 that is typically not cemented. A horizontal liner 10 with slotted openings and/or wire-wrappings is inserted. There is an open annulus 12 between the liner 10 and the formation 2. Inside the liner 10, a first long tubing 16 is deployed to the end of the horizontal well section called the toe 18. A second, short tubing 20 is also inserted to the start of the horizontal well section called the heel 22. The wells 4, and especially the production well, are preferably completed to allow flow of the oil to be produced and other by-products such as condensed stimulant, but to block active vaporous or gaseous stimulant from being produced. Such completion methods are known in the art and taught, for example in a U.S. Pat. No. 4,344,485 to Butler. Variations to the orientation and completion of the wells 4 are also possible and would be well understood by a person of skill in the art to be encompassed by the scope of the present invention.

Figure 5A:
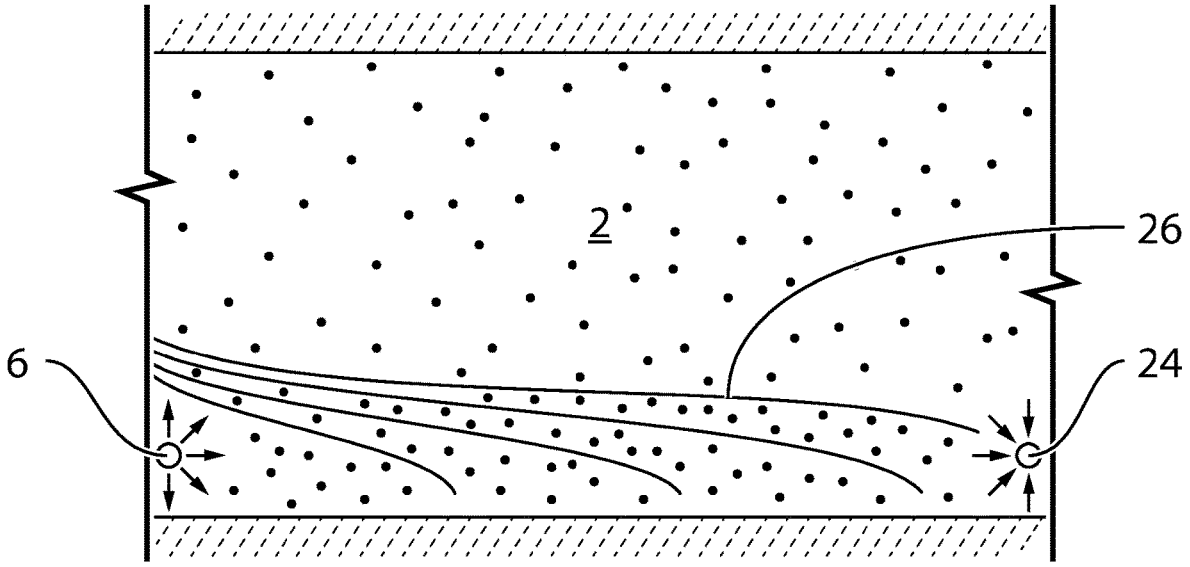
FIG. 5*a* is a front elevation view of the wells shown in FIG. 2 during a second stage of the present invention.
Figure 5B:
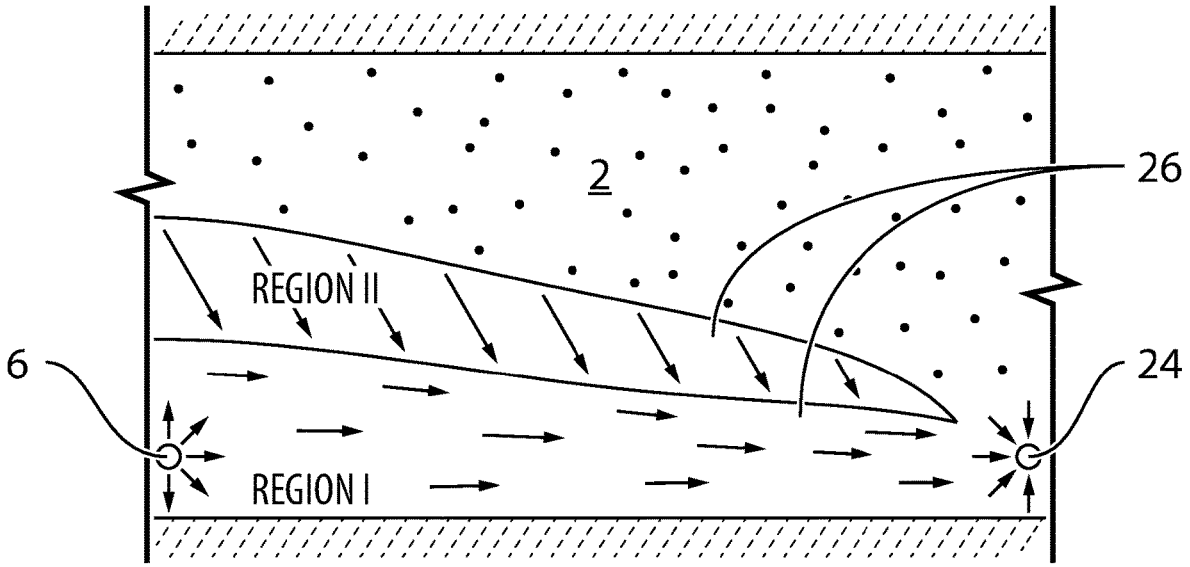
FIG. 5*b* is a front elevation view of the wells shown in FIG. 2 during a third stage of the present process.

After the horizontal wells 4 are drilled and completed, the present process preferably proceeds in the following three stages: (1) Horizontal high-mobility zone forming stage; (2) Production start-up; and (3) Continuos oil production stage. They are illustrated in FIGS. 5*a* and 5*b*.

The present invention is particularly appealing to producing the oilsands or heavy oil reservoirs where steam or other stimulants are required to reduce the oil viscosity. However, the process can be applied to any reservoirs which require secondary or tertiary recovery processes. The latter includes depleted reservoirs after the primary production. The terms oil, petroleum and hydrocarbon are to be understood to be used interchangeably for the purposes of the present invention.

In the case of some preferred stimulants such as steam, the steam heats the heavy hydrocarbon liquid to reduce viscosity. In other cases, the stimulant, such as solvent, has viscosity lowering properties that serve to lower viscosity of the heavy hydrocarbons. In the case of enhanced or tertiary recovery of low-viscosity conventional oil, the rising stimulant has properties that reduce the surface tension between the hydrocarbon oil phase and the displacing fluid, thus enabling the oil draw down. In all, as the stimulant moves upwards, it displaces the relatively heavier hydrocarbon liquid that then drains downward into the high-mobility zone due to the gravity.

When the hydrocarbon liquid drains downwards, it is also being driven towards the production well due to the pressure difference between the injection and production wells. The present process progresses relatively uniform from the bottom of the reservoir upwards, thus enabling more reservoir contact, a faster and more complete recovery of the hydrocarbons.

Step 1: Formation of Horizontal High-mobility Zone Along the Bottom of Reservoir.

As the first step, one or more horizontal high-mobility zones are formed close to the base of the reservoir connecting the two neighboring horizontal wells 4. They can be created via a variety of ways, so long as they cause early communication between the two neighboring wells along the bottom of the reservoir.

Early communication allows stimulant injected in Step 2 of the present method to more readily break through from an injector well towards a production well, and the injected stimulant comes into contact with a large area of the reservoir.

The horizontal high-mobility zones are formed close to the bottom of the reservoir. Formation of the horizontal high-mobility zone along the bottom of the reservoir enables the reservoir stimulation and recovery process to proceed from the bottom upwards to the reservoir top along a relatively horizontally flat front. The operational outcome is better conformance of the stimulant in the reservoir, higher reservoir recovery and insensitivity to the presence of top features such as top water, top gas or absence of competent caprock.

The high-mobility zone formed between the two wells 4 does not have to be strictly horizontal, but should be substantially horizontal. In a preferred embodiment, the production well may be lower than the injection well to enhance the flow of hydrocarbon liquid towards the production well by gravity.

There are several methods to create the horizontal high-mobility zone. Some examples are cited below, but other methods of creating a horizontal high-mobility zone can be used without deviating from the scope of the present invention:

(a) Controlled dilation and fracturing via high-pressure injection—in such cases, high-pressure injection is made into the bottom of the reservoir either along a horizontal well that is placed near the bottom of the reservoir or by injecting into an interval on a vertical well that is perforated near the bottom of the reservoir. Injection fluids include any fluid that can be injected into the formation, which can raise pore pressure and can stimulate the hydrocarbon. Steam, solvents, water or heated water or any other injection fluids can be used to form the fracture or dilation zone. A liquid injection fluid such as water, heated water or solvent is preferred since liquids tend to flow downwards to the bottom of the reservoir. Alternatively, the typed of injection fluid can be changed over time during the initiation of the high-mobility zone. Proppants may further preferably also be injected to prop open the fracture zone formed.

(b) Utilizing naturally-occurring high-mobility zones such as for example a bottom water zone.

(c) Early cyclic steam stimulation (CSS) from both wells on both ends of the high-mobility zone to be created, so that an early communication channel is established between the wells along the horizontal direction near the bottom of the reservoir. CSS can be done in combination with controlled dilation and fracturing described in option (a) above, or it can be performed in a non-fractured or non-dilated formation.

(d) Cold heavy oil production (CHOP)—this process produces sands with the heavy oil. CHOP is often utilized in early reservoir production and result in wormholes formed into the reservoir. These wormholes from an earlier CHOP process, can then be used to create the horizontal high-mobility zone of the present invention. If the access to the reservoir is made near the bottom of the reservoir by perforating a vertical well or placing the horizontal well, wormholes may extend into the reservoir laterally close to the bottom of the reservoir and eventually connect two adjacent wells. This process is preferably used under in-situ stress condition and/or reservoir properties in which horizontal wormholes are formed that can then be used to form the horizontal high-mobility zone.

Other variations and methods are also possible for creating the high-mobility zone including, for example, by drilling closely-spaced wells, vertical or horizontal, to mechanically cause the inter-well communication near the bottom of the reservoir.

Step 2: Production Start-up Stage

The second stage of the invention is to start up the production by injecting a stimulant into the high-mobility zone formed in Stage 1. This is illustrated in FIG. 5*a*. The goal in Stage 2 is to establish the initial contact area between the stimulant and the reservoir across the bottom of the reservoir along the length of the horizontal wells. At the end of Stage 2, a flat horizontally-oriented stimulant chamber is formed at the base of the reservoir.

Preferably the stimulant further stimulates the reservoir formation by either reducing the oil viscosity and/or reducing the interfacial tension that prevents the oil phase from flowing out of the pores.

Some example stimulants useful for the present invention include: steam, solvent in vapor form, carbon dioxide (CO2), air, nitrogen (N2), oxygen (O2), hydrogen sulphide (H2S), non-condensable gases (NCG), or mixture of these materials. Some of these materials can be used as a carrying agent for other active functional materials. For example, air may be mixed with some chemical catalysts to form a foamy stimulant to be injected.

Stimulant is injected into the injector well 6 and, at the same time, the production well 24 is opened to produce from the bottom high-mobility layer which has a higher permeability to the water phase than the rest of the formation 2.

At the beginning, stimulant injection rate at the injector well and production rate at the producer well are preferably monitored and managed by well-known means in the art such that the stimulant penetrates predominantly through the high-mobility zone formed in bottom layer of the formation 2. This serves to stimulate the formation 2 and the oil in this layer, reducing viscosity, mobilizing the oil and allowing it to be produced from the production well 24.

It is also possible to change the types of stimulants used over time during this stage of the present method.

In the case of steam as a preferred stimulant, because the initial formation 2 temperatures is far below the steam temperature, resulting in the injected steam condensing as it heats up the oil in the bottom layer, starting near the injector well 6 and slowly spreading towards the production well 24. This condensate travels to the production well 24 and creates the first communication between the injection well 6 and the production well 24. Gradually, as more steam is injected, the high-mobility zone is further heated and stimulated and more oil flows to the production well 24. When the condensed hot water breaks through the producer 24, the production rate is increased to allow the steam to spread across the entire bottom layer to create the first flat steam chamber 26. The above-described process is illustrated in FIG. 5*a*. While the stimulant is active, due to its lower density than the oil to be produced, it continues to rise through the reservoir. In the case of condensable stimulants such as steam and condensable gaseous and vaporous solvents, as the stimulant rises through the reservoir it may condense and such condensed stimulant then typically drains with the oil and is produced at the production well.

In a preferred embodiment, it may be desirable to initially inject the stimulant into the production well 24 for a limited period of time in addition to injecting stimulant into the injection well 6. The injected stimulant serves to stimulate the reservoir, for example, reduce bitumen viscosity, near the production well 24. Consequently, breakthrough from the injector to the producer can be achieved earlier.

Step 3: Continuous Oil Production Stage

After the flat stimulant chamber 26 is formed in the bottom layer of the reservoir 2, continuous oil production begins, as shown in FIG. 5*b*. Oil production in this stage advantageously utilizes two mechanisms: gravity drainage and pressure-driven displacement. More preferably, production by these two mechanisms is balanced, by controlling the production rate of the oil and any condensed stimulant at the production well 24 and/or also by managing stimulant injection pressure and/or rate at the injection well 6. Vaporous or gaseous stimulant is prevented from being produced by utilizing subcool control, commonly practiced in the SAGD industry, at the production well 24.

One recovery mechanism of the present process is stimulant-assisted gravity drainage which is similar in some ways to that described in U.S. Pat. No. 4,344,485. The injected stimulant rises to contact the oil above the flat stimulant chamber while any condensed stimulant and the heated oil fall downwards since the mixture of condensed stimulant and oil is heavier than the active gaseous or vaporous stimulant. This process prevails across the entire horizontal cross-section area of the reservoir as defined by the inter-well distance and horizontal well length.

The second recovery mechanism of the present process is pressure-driven flooding from the injector well 6 to the producer well 24. Since the flat stimulant chamber 26 has been established in Stage 2, stimulant injected from the injector well 6 is lighter than the oil in the formation 2 and tends to both rise upwards and flow laterally towards the production well 24 due to the pressure difference between the higher pressure injector well 6 and lower pressure producer well 24.

It is should be noted that the displacement mechanism of the present process is different from that of both traditional steam flooding and CSS processes in that the present process creates two distinct regions of stimulant displacement as denoted in FIG. 5*b*. Before the present Stage 3, the first region denoted by Region I in FIG. 5*b* is filled mainly with condensed stimulant and some trapped residual oil. As the flat bottom up process continues, the condensed stimulant accumulates at the bottom of the reservoir and slowly pushes the stimulant chamber up as denoted by Region II. The displacement through Region I is the newly condensed stimulant formed near the injector well 6 displacing the previously formed condensed stimulant and entrained oil. The displacement through Region II is the newly injected stimulant displacing the falling oil and condensed stimulant.

Because the injected stimulant from the injector well 6 pushes both the heated oil and condensed stimulant towards the producer well 24, both displacement regions become increasingly curved from a high end proximal to the injection well 6 to a lower end near the production well 24. The shapes and relative sizes of the two displacement regions are determined by the production rate under a constant injection pressure or the production pressure under a constant injection rate or any other combination of injection rate or pressure with production rate or pressure. Typically, a slow rate or low pressure at the production well will result in relative flat regions and a fast rate or high pressure at the production well 24 increases the slopes of the both regions.

The types of stimulant used in this stage of the present method may be the same or different than the stimulants used in stage 2 of the present method. As well, the types of stimulants used may be changed over time during this stage of the present method.

Operating conditions optimize the balance between the mechanisms of gravity drainage and pressure driven flooding should be chosen in accordance with reservoir characteristics such as horizontal and vertical permeabilities, oil viscosity at elevated temperatures and other parameters that would be well known to a person of skill in the art. In a most preferred embodiment, the production rate is adjusted to allow a liquid pool of oil and any condensed stimulant surrounding the producer well 24, which pool serves to prevent active vaporous or gaseous stimulant in the reservoir from being produced through the production well 24. The latter is commonly practised in SAGD operation.

The foregoing disclosure represents one embodiment of the present invention. As will be apparent to those skilled in the art in the light of the foregoing disclosure, many alterations and modifications are possible in the practice of this invention without departing from the spirit or scope thereof.

EXAMPLE

The following example serves merely to illustrate certain embodiments of the present invention, without limiting the scope thereof, which is defined only by the claims.

Two-Dimensional Laboratory Model

A two-dimensional laboratory scale experiment has been performed of the present process. As shown schematically in FIG. 6*a*, an injector well is situated at the lower left corner of the model and a producer well is located at the lower right corner of the model. Both wells are perpendicular to the two-dimensional model to represent part of the long horizontal wells in the three dimensional cases. The model is 9" long, 6" high and 1" thick with a 2" thick Plexiglas™ window for visualizing steam chamber development. The two wells were ⅜" in diameter and perforated along their circumference (1/10" in diameter) and covered with 200-mesh metal screens that prevent sand from flowing out of the producer well.

Figure 7:
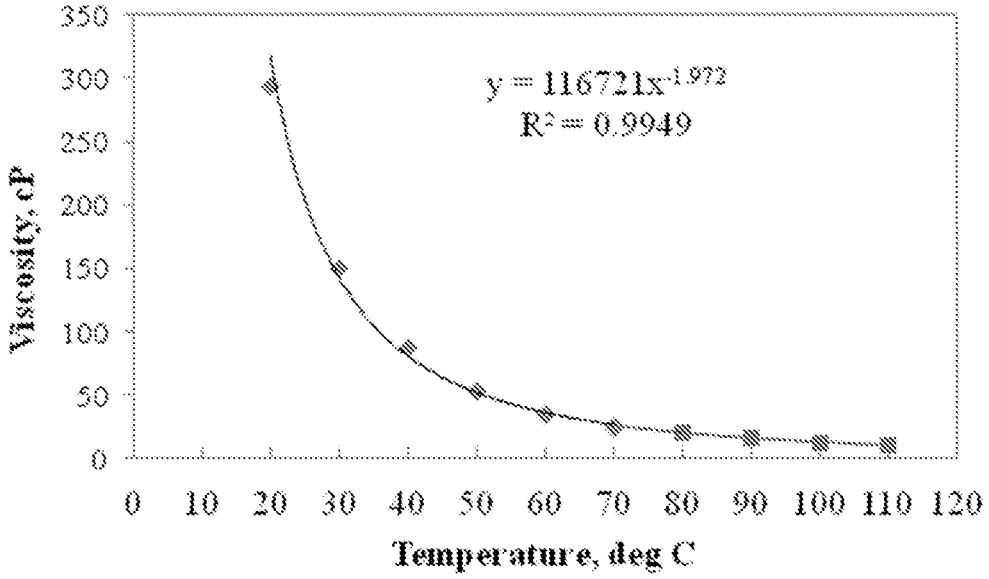
FIG. 7 is a plot of viscosity versus temperature for the heavy oil sample used in the laboratory scale model.

The model was filled with 30-50 mesh sand with a porosity of 33% and permeability of 16.8 darcies. A high permeability layer of 2 cm in thickness was formed along the bottom of the model. A heavy oil sample with a viscosity of 290 mPa·s at the ambient temperature (21° C.) was used in the laboratory experiment. The viscosities of the heavy oil between the ambient temperature and 70° C. were measured and extrapolated to 115° C. by using mathematical regression method as shown in FIG. 7.

The model was flooded with the oil at room temperature to make sure the model is completely saturated with the oil. After it was saturated with the heavy oil, water was slowly injected into the model through the injector well and the producer well was open to produce the oil from the high-mobility zone at the bottom of the model formation. After water broke through the bottom layer of the model, water injection was continued until water saturation reached about 45% which is sufficient for starting up the flat-bottom up process when the steam injection begins.

After the water saturation in the high permeable bottom layer was set, steam was injected into the model through the injector well at about 15 psig. Condensate and heated oil was produced from the producer well. The development of the steam chamber profile during the course of the experiment was recorded through the transparent window of the model.

Figure 6:
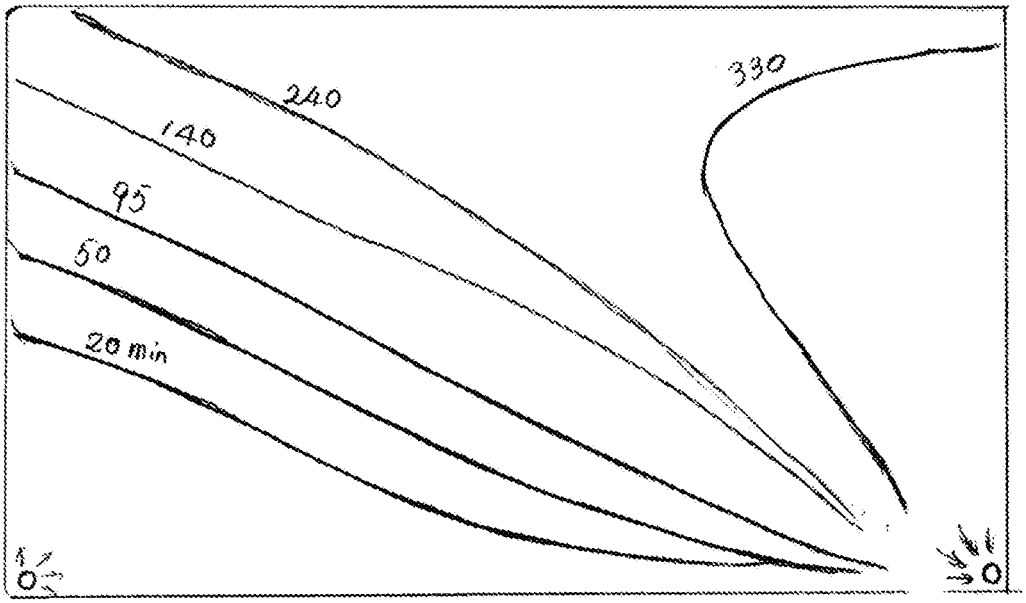
FIG. 6*a* is a schematic illustration of stimulant movement over time, measured in minutes, as predicted by a lab scale model.
FIG. 6*b* is a schematic illustration of stimulant movement over time, measured in minutes, as predicted by a simulation of the lab scale model.
Figure 6:
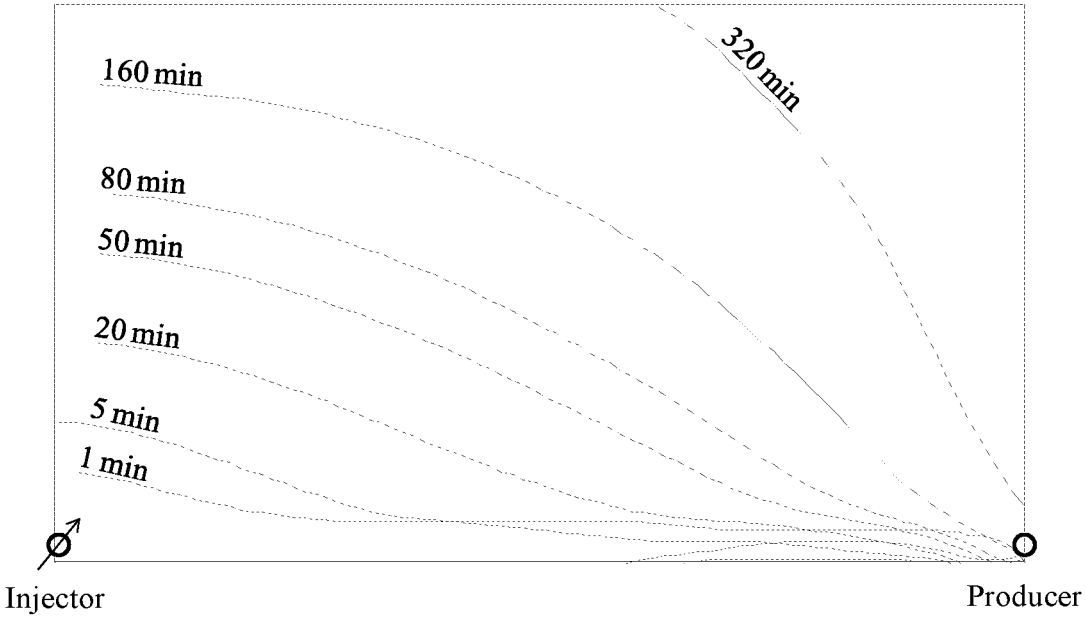
Figure 8:
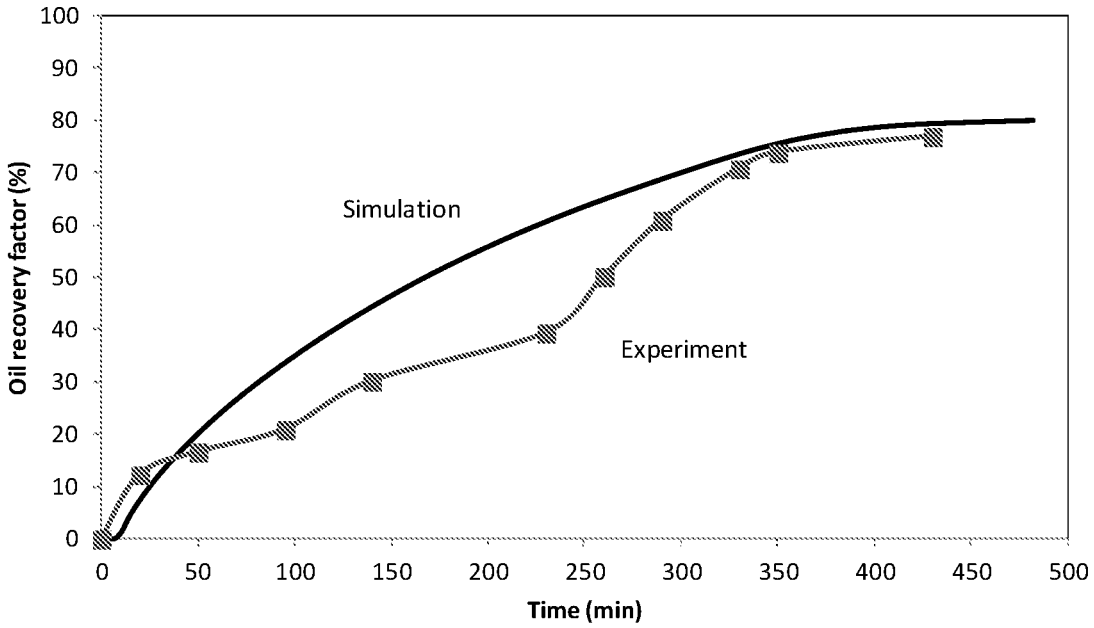
FIG. 8 is a plot of cumulative fractional oil recovery as a function of stimulant injection time, for both the simulation and lab scale model.

The outlines of the steam-oil boundary at six injection times are shown in FIG. 6*a*. The evolution of the steam chamber in the laboratory scale model experiment demonstrates that when a flat steam chamber is formed at the bottom of the reservoir, the combination of the two recovering mechanisms, gravity drainage and pressure difference act to continuously remove the mobile oil in the model of the production well. The cumulative oil recovery as a function of steam injection time is plotted in FIG. 8. It is noted that approximately 80% of the oil in the model can be recovered.

Using numerical modeling technique, the above-described physical model test was simulated. Viscosity of the oil used in the model tests and its dependence on temperature was measured as presented in FIG. 7 which was used in the simulation. The steam was assumed to be generated at 15 psig to heat up the oil. Initially, the sands in the model were at a temperature of 21° C. In the simulation the production was controlled by applying a subcool of 20° C. The simulated evolution of the steam-oil interface is shown in FIG. 6*b*. The results of cumulative fractional oil recovery versus injection time for both physical model and simulation are compared in FIG. 8.

The invention claimed is:

1. A method of producing hydrocarbons from a reservoir, said method comprising:

a. drilling at least two wells located proximal to a bottom of said reservoir, said at least two wells being substantially parallel and co-planar to one another;

b. initiating a high-mobility zone connecting said wells along the bottom of the reservoir to create communication therebetween;

c. forming a flat stimulant chamber that follows along the bottom of the reservoir between the wells in the high-mobility zone; and d. producing the reservoir from the bottom of said reservoir upwards, after forming the flat stimulation chamber.

2. The method of claim 1, wherein forming the flat stimulant chamber and producing the reservoir further comprise the steps of:

c.(i) injecting a stimulant through a first well of said at least two wells into the high mobility zone at a pressure that is at least greater than the formation pressure of the reservoir to form the flat stimulant chamber in the high-mobility zone;

c.(ii) producing at least one of condensed stimulant and hydrocarbon from a second well of said at least two wells; and c.(iii) continuously injecting stimulant at the first well while producing hydrocarbon at the second well by pressure drive.

3. The method of claim 2, further comprising, prior to initiating the high-mobility zone, the step of:

a.(i) conditioning the reservoir to create a stress condition for forming the high-mobility zone along the bottom of the reservoir.

4. The method of claim 2, wherein said stimulant is selected from the group consisting of steam, solvent in vapor form, carbon dioxide, air, nitrogen ($N_2$), oxygen ($O_2$), hydrogen sulphide ($H_2S$), non-condensable gases, and mixture thereof.

5. The method of claim 4, wherein said stimulant is mixed with a chemical catalyst to form a foamy stimulant.

6. The method of claim 4, wherein the stimulant is steam that acts to heat the hydrocarbon to reduce viscosity of the hydrocarbon.

7. The method of claim 4, wherein the stimulant has viscosity lowering properties that serves to lower viscosity of the hydrocarbon.

8. The method of claim 4, wherein the stimulant has interfacial tension reducing properties to reduce the interfacial tension of the hydrocarbon to be produced.

9. The method of claim 4, wherein the stimulant type is altered over the course of time during stimulant injection.

10. The method of claim 2, wherein the two or more wells are coplanar.

11. The method of claim 2, wherein the second well is lower than the first, injector well.

12. The method of claim 2, further comprising injecting the stimulant through the second well prior to producing the at least one of condensed stimulant and hydrocarbon from the second well.

13. The method of claim 2, wherein a rate of production of at least one of condensed stimulant and hydrocarbon is adjusted to allow a liquid pool of hydrocarbon and condensed stimulant to surround the second well.

14. The method of claim 1, wherein the high-mobility zone is a dilation zone.

15. The method of claim 14, further comprising injecting an injection fluid into the first, injector well into the reservoir at high-pressure to form said dilation zone.

16. The method of claim 15, wherein the injection fluid is selected from the group consisting of steam, hot water, chemical solutions, solvents and mixtures thereof.

17. The method of claim 16, wherein the injection fluid type is altered over time during initiating of the high-mobility zone.

18. The method of claim 15, wherein the injection fluid is a proppant-laden fluid to prop open the dilation zone formed.

19. The method of claim 1, wherein the high-mobility zone is a naturally occurring zone.

20. The method of claim 1, wherein the high-mobility zone is initiated by formation of wormholes proximal the bottom of the reservoir between the wells after a cold heavy oil production (CHOP) process.

* * * * *